US005966152A

United States Patent [19]

Albinsson

[11] Patent Number: 5,966,152

[45] Date of Patent: Oct. 12, 1999

[54] FLEXIBLE SUPPORT APPARATUS FOR DYNAMICALLY POSITIONING CONTROL UNITS IN A PRINTHEAD STRUCTURE FOR DIRECT ELECTROSTATIC PRINTING

[75] Inventor: Urban Albinsson, Mölndal, Sweden

[73] Assignee: Array Printers AB, Västra Frölunda, Sweden

[21] Appl. No.: 08/757,876

[22] Filed: Nov. 27, 1996

[51] Int. Cl.[6] ..... B41J 2/06

[52] U.S. Cl. ..... 347/55; 347/141

[58] Field of Search ..... 347/55, 112, 141

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,779,166 | 12/1973 | Pressman et al. . |
| 3,815,145 | 6/1974 | Tisch et al. . |
| 4,263,601 | 4/1981 | Nishimura et al. . |
| 4,274,100 | 6/1981 | Pond . |
| 4,353,080 | 10/1982 | Cross . |
| 4,382,263 | 5/1983 | Fischbeck et al. . |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |
| 12 70 856 | 6/1968 | Germany . |
| 26 53 048 | 5/1978 | Germany . |
| 44-26333 | 11/1969 | Japan . |
| 5555878 | 4/1980 | Japan . |
| 5584671 | 6/1980 | Japan . |
| 5587563 | 7/1980 | Japan . |
| 5689576 | 7/1981 | Japan . |
| 58-044457 | 3/1983 | Japan . |
| 58155967 | 9/1983 | Japan . |
| 62-248662 | 10/1987 | Japan . |
| 6213356 | 11/1987 | Japan . |
| 01120354 | 5/1989 | Japan . |
| 05220963 | 8/1990 | Japan . |
| 04189554 | 8/1992 | Japan . |
| 4-268591 | 9/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |
| 9201565 | 2/1992 | WIPO . |

OTHER PUBLICATIONS

Jerome Johnson, "An Etched Circuit Aperture Array for TonerJet® Printing", *IS&T's Tenth International Congress on Advances in Non–Impact Printing Technologies*, 1994, pp. 311–313.

*Primary Examiner*—Arthur T. Grimley
*Assistant Examiner*—Quana Grainger
*Attorney, Agent, or Firm*—Knobbe, Martens, Olson & Bear, LLP

[57] ABSTRACT

A print head structure including:

a particle source for delivering charged particles to an information carrier;

a control unit for controlling transfer of the charged particles from the particle source to the information carrier, the control unit being arranged on a carrier sheet of flexible non-rigid material; and a support element for supporting the control unit in a predetermined position in relation to the particle source, the support element comprising a guiding edge, whereby the carrier sheet is fixed to the support element along said guiding edge with a portion of the carrier sheet carrying the control unit protruding beyond said guiding edge.

9 Claims, 3 Drawing Sheets

U.S. PATENT DOCUMENTS 4,384,296 5/1983 Torpey .
4,386,358 5/1983 Fischbeck .
4,470,056 9/1984 Galetto et al. .
4,478,510 10/1984 Fujii et al. .
4,491,794 1/1985 Daley et al. .
4,491,855 1/1985 Fujii et al. .
4,498,090 2/1985 Honda et al. .
4,511,907 4/1985 Fukuchi .
4,525,727 6/1985 Kohashi et al. .
4,571,601 2/1986 Teshima .
4,675,703 6/1987 Fotland .
4,717,926 1/1988 Hotomi .
4,743,926 5/1988 Schmidlin et al. .
4,748,453 5/1988 Lin et al. .
4,814,796 3/1989 Schmidlin .
4,831,394 5/1989 Ochiai et al. .
4,837,071 6/1989 Tagoku et al. .
4,860,036 8/1989 Schmidlin .
4,903,050 2/1990 Schmidlin .
4,912,489 3/1990 Schmidlin .
5,028,812 7/1991 Bartky .
5,036,341 7/1991 Larsson .
5,038,159 8/1991 Schmidlin et al. .
5,057,855 10/1991 Damouth .
5,072,235 12/1991 Slowik et al. .
5,083,137 1/1992 Badyal et al. .
5,095,322 3/1992 Fletcher .
5,121,144 6/1992 Larson et al. .
5,128,695 7/1992 Maeda .
5,148,595 9/1992 Doggett et al. .
5,170,185 12/1992 Takemura et al. .
5,181,050 1/1993 Bibl et al. .
5,204,696 4/1993 Schmidlin et al. .
5,204,697 4/1993 Schmidlin .
5,214,451 5/1993 Schmidlin et al. .
5,229,794 7/1993 Honman et al. .
5,235,354 8/1993 Larson .
5,237,346 8/1993 Da Costa et al. .
5,256,246 10/1993 Kitamura .
5,257,045 10/1993 Bergen et al. .
5,270,729 12/1993 Stearns .
5,274,401 12/1993 Doggett et al. .
5,307,092 4/1994 Larson .
5,329,307 7/1994 Takemura et al. .
5,374,949 12/1994 Wada et al. .
5,386,225 1/1995 Shibata .
5,402,158 3/1995 Larson .
5,414,500 5/1995 Furukawa ..... 347/55
5,446,478 8/1995 Larson .
5,450,115 9/1995 Bergen et al. .
5,453,768 9/1995 Schmidlin .
5,473,352 12/1995 Ishida .
5,477,246 12/1995 Hirabayashi et al. .
5,477,250 12/1995 Larson .
5,506,666 4/1996 Masuda et al. .
5,508,723 4/1996 Maeda .
5,515,084 5/1996 Larson .
5,526,029 6/1996 Larson et al. .
5,558,969 9/1996 Uyttendaele et al. .
5,559,586 9/1996 Wada .
5,600,355 2/1997 Wada .
5,614,932 3/1997 Kagayama .
5,617,129 4/1997 Chizuk, Jr. et al. .
5,625,392 4/1997 Maeda ..... 347/55
5,640,185 6/1997 Kagayama .
5,650,809 7/1997 Kitamura .
5,666,147 9/1997 Larson ..... 347/112
5,677,717 10/1997 Ohashi .
5,708,464 1/1998 Desie .
5,774,159 6/1998 Larson .
5,805,185 9/1998 Kondo .
5,818,480 10/1998 Bern et al. .
5,818,490 10/1998 Larson .
5,847,733 12/1998 Bern .

FLEXIBLE SUPPORT APPARATUS FOR DYNAMICALLY POSITIONING CONTROL UNITS IN A PRINTHEAD STRUCTURE FOR DIRECT ELECTROSTATIC PRINTING

FIELD OF THE INVENTION

The present invention relates to image recording methods and devices and, more particularly, to a device for positioning and supporting an array of control electrodes in relation to a particle carrier to enhance print quality in a direct electrostatic printing device.

DESCRIPTION OF RELATED ART

The most well known and widely utilized electrostatic printing technique is that of xerography wherein latent electrostatic images formed on a charge retentive surface, such as a roller, are developed by the use of a suitable toner material to render the images visible, the images being subsequently transferred to an information carrier.

This process is called an indirect process because it first forms a visible image on an intermediate surface and then transfers that image to an information carrier.

Another method of electrostatic printing is one that has come to be known as direct electrostatic printing. This method differs from the aforementioned xerographic method in that charged pigment particles (toner) are deposited directly onto an information carrier to form a visible image. In general, this method includes the use of electrostatic fields controlled by addressable electrodes for allowing passage of toner particles through selected apertures in a printhead structure. A separate electrostatic field is provided to attract the toner particles to an information carrier in an image configuration.

The distinguishing feature of direct electrostatic printing is its simplicity of simultaneous field imaging and particle transport to produce a visible image on the information carrier directly from computer generated signals, without the need for those signals to be intermediately converted to another form of energy such as light energy, as is required in electrophotographic printers, e.g. laser printers.

U.S. Pat. No. 5,036,341, granted to Larson, discloses a direct printing device and a method to produce text and pictures on an image receiving substrate directly from computer generated signals. According to that method, a control electrode array, formed of a latticework of individually controlled wires, is positioned between a back electrode and a rotating particle carrier. An image receiving substrate, such as paper, is then positioned between the back electrode and the control electrode array.

A uniform electric field is generated between a high potential on a back electrode and a low potential on a particle carrier to thereby attract the toner particles from the surface of the particle carrier and to create a particle stream toward the back electrode. The particle stream is modulated by a series of voltage sources which apply an electric potential to selected individual wires of the control electrode array to produce electrostatic fields which permit or restrict particle transport from the particle carrier. In effect, these electric fields "open" or "close" selected apertures in the control electrode array to the passage of toner particles by influencing the attractive force from the back electrode. The modulated stream of charged particles allowed to pass through selected apertures impinge upon a print receiving medium interposed in the particle stream to provide line-by-line scan printing to form a visible image.

The control electrode array described in the above mentioned patent is in the form of a lattice of individual wires arranged in rows and columns. A control electrode array operating according to the described principle may, however, take on any one of several other designs. Generally, the array is a thin sheet-like element, referred to as a Flexible Printed Circuit or FPC, comprising a plurality of addressable control electrodes and corresponding voltage signal sources connected thereto for attracting charged toner particles from the surface of a particle carrier to an information carrier. A sequence of electronic signals, defining the image information, is converted into a pattern of electrostatic fields which locally modify the uniform field from a back electrode, thereby selectively permitting or restricting the transport of charged particles from the particle carrier and producing an image pattern corresponding to the electrostatic field pattern onto the information carrier.

A flexible control array or FPC as disclosed in, for example, U.S. Pat. No. 5,121,144, also granted to Larson, is made of a flexible, electrically insulating, non-rigid material, such as polyimide or the like, which is provided with a multiplicity of apertures and is overlaid with a printed circuit whereby the apertures in the material are arranged in rows and columns and are surrounded by ring shaped electrodes. A uniform electrostatic field generated by a back electrode attracts toner particles from a particle source to create a particle stream through the FPC toward the back electrode. All control electrodes are initially at a white potential, $V_w$ which means that toner transport from the particle carrier toward the back electrode is inhibited. As image locations on an information carrier are made to pass beneath the apertures, selected control electrodes are set to a black potential $V_b$ to produce an electrostatic field drawing the toner particles from the particle source. The charged toner particles pass through the apertures in the FPC and are subsequently deposited on the information carrier in the configuration of the desired image pattern. The toner particle image is then made permanent by using heat and pressure to fuse the toner particles to the surface of the information carrier.

The variable electric forces applied to the individual control electrodes act either to attract or repel the toner particles positioned on the surface of the particle carrier. The electric forces must be carefully regulated to be above or below a predetermined transport threshold value corresponding to a print mode and a no print mode respectively. The threshold value is strongly dependent on the gap distance between the FPC and the surface of the particle carrier. The gap distance is generally in the order of about 50 microns and may vary within ±5 microns without severely affecting the print quality. Therefore, it is essential to provide a constant and uniform gap distance to maintain high print quality.

Further, when a control electrode is in the print mode, the attractive force must not be changed until the toner particles have gained sufficient momentum to pass through the corresponding aperture in the FPC. The time required for the charged particles to be transported through an aperture is also dependent on the gap distance between the FPC and the surface of the particle carrier.

Accordingly, even very minor variations in the gap distance between the FPC surface and the particle carrier surface may significantly and adversely affect the accuracy of the print control function, resulting in undesired size variation or density variation in the printed dots and degradation of the print readability.

It is desirable to arrange the FPC as closely to the toner carrier as possible without actually contacting the toner layer. Since the gap distance, as mentioned, typically is in the order of about 50 microns, even the slightest mechanical imperfections may cause a drastic degradation of the print quality.

One type of particle carrier which is frequently used has the form of a smooth cylindrical sleeve. It is, however, not possible to avoid minor imperfections in the sleeve, and consequently in reality the sleeve is never either perfectly cylindrical or perfectly smooth. In addition to the defects that may be found in the cylindrical sleeve, the layer of toner particles coating the sleeve may have a thickness which is slightly non-uniform. Furthermore, the diameter of the particles themselves may vary and their shape may show deviations from an ideal spherical shape. The given examples illustrate only a few of the numerous irregularities which may cause variations in the actual gap distance found between the FPC and the particle carrier.

A further source of variations in the gap distance is the mounting of the FPC in the print head structure. During the positioning of the FPC in alignment with the particle carrier, the FPC material may be deformed into a slight wave-shape due to non-uniform tension being applied to the material. Likewise, forces arising from the printing process itself may cause deformation which will affect the gap distance. Accordingly, to achieve a minimal, constant and uniform gap distance between the FPC and the particle carrier, while at the same time producing a uniform tension over the whole FPC surface and further to maintain these conditions during the whole print procedure, has proven to be one of the most critical steps of a direct printing method.

It is particularly important to maintain a constant and uniform gap distance between the FPC surface and the particle carrier in order to achieve an improved print quality by enhancing the grey scale capability of the print head. The image configuration is formed by a plurality of dots having variable form and/or degree of darkness to create different shades in the range between white and maximal darkness. The control signals can be modulated with high precision to allow a specific amount of toner particles to be transported through each aperture in the FPC, the amount of toner particles transported through each aperture thereby corresponding to a certain grey level or shade. To obtain a satisfying grey scale capability when using a direct printing method, it is thus highly desirable to eliminate or at least considerably reduce the problems associated with irregularities occurring in the gap distance between the FPC and the particle carrier.

Therefore, to ensure a uniform print quality and to enhance the grey scale capability of a direct electrostatic printing process, a need has been identified for an improved support device for a control unit in a print head structure offering the required surface evenness, alignment and tension uniformity to the control unit material used in the process.

SUMMARY OF THE INVENTION

The present invention provides a means for improving the printing quality of a direct electrostatic printing device. By means of the invention it is possible to maintain a constant and minimal gap distance between a print control unit and a particle carrier.

Thus, according to the invention there is provided a print head structure including:

- a particle source for delivering charged particles to an information carrier;
- a control unit for controlling transfer of the charged particles from the particle source to the information carrier, the control unit being arranged on a carrier sheet of flexible non-rigid material;
- a support element for supporting the control unit in a predetermined position in relation to the particle source, the support element comprising a guiding edge, whereby the carrier sheet is fixed to the support element along said guiding edge with a portion of the carrier sheet carrying the control unit protruding beyond said guiding edge.

Preferably, the flexible control unit comprises an electrically insulating, flexible substrate.

The flexible control unit may be adhesively fixed to the support device. Alternatively the flexible control unit may be welded or mechanically fixed to the support device.

According to the invention there is also disclosed a print head structure for direct electrostatic printing, including:

- a back electrode;
- a particle carrying unit for conveying charged particles to a particle source positioned adjacent to the back electrode;
- a control unit interposed between the back electrode and the particle carrying unit for converting a stream of electronic signals, defining an image information, to a pattern of electrostatic fields that selectively permit or restrict transport of said charged particles from the particle source toward the back electrode; and
- a support element for supporting a control unit in a predetermined position in relation to the particle source, the support element comprising a guiding edge; the control unit being arranged on a sheet of a substrate of flexible, non rigid material, whereby the sheet is fixed to the support element along the guiding edge, and whereby a portion of the sheet carrying the control unit protrudes beyond the guiding edge.

The support device according to the invention requires very little force in order to apply the control unit to the device and to keep the control unit at a constant and uniform distance from the particle source in the printing device. Accordingly, no deforming tensional forces are created in the flexible control unit either during the positioning step or when printing is being performed.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF EMBODIMENTS

Figure 1:
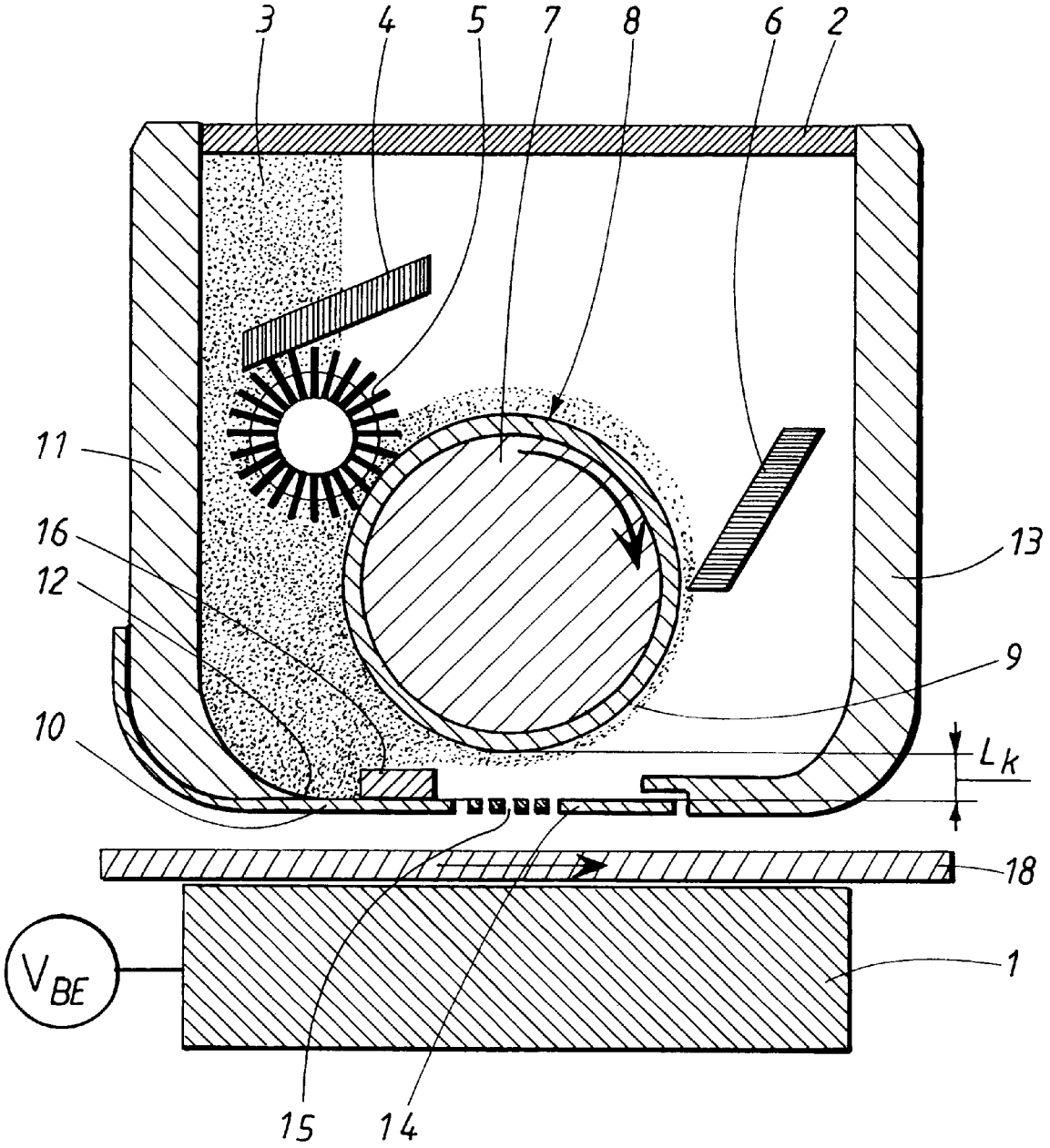
FIG. 1 is a schematic sectional view of a direct printing apparatus.

The direct electrostatic print head structure shown in FIG. 1 includes a back electrode 1 connected to a back voltage source $V_{BE}$, which is placed at a distance from a particle supplying unit 2. The particle supplying unit 2 comprises a particle container 3, a particle feeder 4, a rotating supply brush 5, a metering blade 6 and a rotating developer sleeve 7 having a surface 8 which is coated with a thin layer 9 of uniformly charged toner particles.

A flexible control unit or FPC, 10 formed of a rectangular sheet of a flexible substrate of electrically insulating, non-rigid material provided with a multitude of control electrodes, is mounted on a supporting wall 11 and is held at a constant, uniform distance $L_k$ from the surface 8 of the developer sleeve 7 by a guiding edge 12 arranged on the supporting wall 11. The guiding edge 12 can either be part of a separate element mounted on the supporting wall 11 or can be made as an integral extension of the supporting wall 11. In FIG. 1, the wall 11 supporting the FPC 10 is one of two side walls 11,13 of the particle container 3. The FPC 10 is attached to the outside surface of the side wall by any suitable attachment means, such as mechanical attachment means, adhesive or by welding. The supporting side wall 11 has a curved and tapered edge 12, which serves as the guiding edge 12 for the cantilevered FPC 10. The FPC 10 has a portion which extends away from the guiding edge 12, and forms a flexible flap 14 of the substrate carrying the control electrodes (not visible in FIG. 1).

The flexible flap 14 protrudes into an area in the vicinity of the developer sleeve surface defined as the print zone 15 of the print head structure. An elongated spacer means 16 is arranged on the flexible flap 14 parallel with the guiding edge 12. The thickness of the spacer means 16 is chosen so that it substantially corresponds to the distance between the flexible flap and the layer 9 of charged particles on the surface 8 of the developer sleeve 7. During printing, the spacer means 16 contacts and rides on top of the layer 9 of charged particles. In order to maintain the contact between the spacer means 16 and the layer 9 of charged particles the flexible flap 14 is preferably slightly tensioned against the layer 9 of charged particles. The flexible flap 14 is made of a material that is resiliently bendable. The resiliency depends both on the type of material used, and on the thickness of the material. Further, the ability of the flexible flap 14 to flex in response to movements in the spacer means 16 depends on the position of the spacer means on the flexible flap. If the spacer means 16 is positioned closely to the guiding edge 12 it will not affect the flexible flap 14 as much as if it is positioned at a comparatively large distance from the guiding edge 12. The skilled person will recognize that the position of the spacing means must be chosen with regard to the properties of the material in the flexible flap 14 while at the same time taking into consideration the distance between the flexible flap and the layer 9 of charged particles, since this distance decides the thickness of the spacer means 16.

Due to the resilient properties of the flexible flap 14, the gap distance, $L_k$, between the FPC 10 and the developer sleeve surface 8 is continuously and automatically adjusted. Irregularities appearing in the developer sleeve surface 8 or in the particle layer 9 cause the flexible flap 14 to move away from the developer sleeve surface 8 or spring back towards the surface 8 depending on the type of defect causing the movement. Accordingly, during printing the movement of the flexible flap 14 will compensate for variations in the gap distance, $L_k$, between the developer sleeve surface 8 and the control unit 10.

An information carrier 18, such as a sheet of plain, untreated paper is fed between the FPC 10 and the back electrode 1 by means of a feeding unit (not shown).

Figure 2:
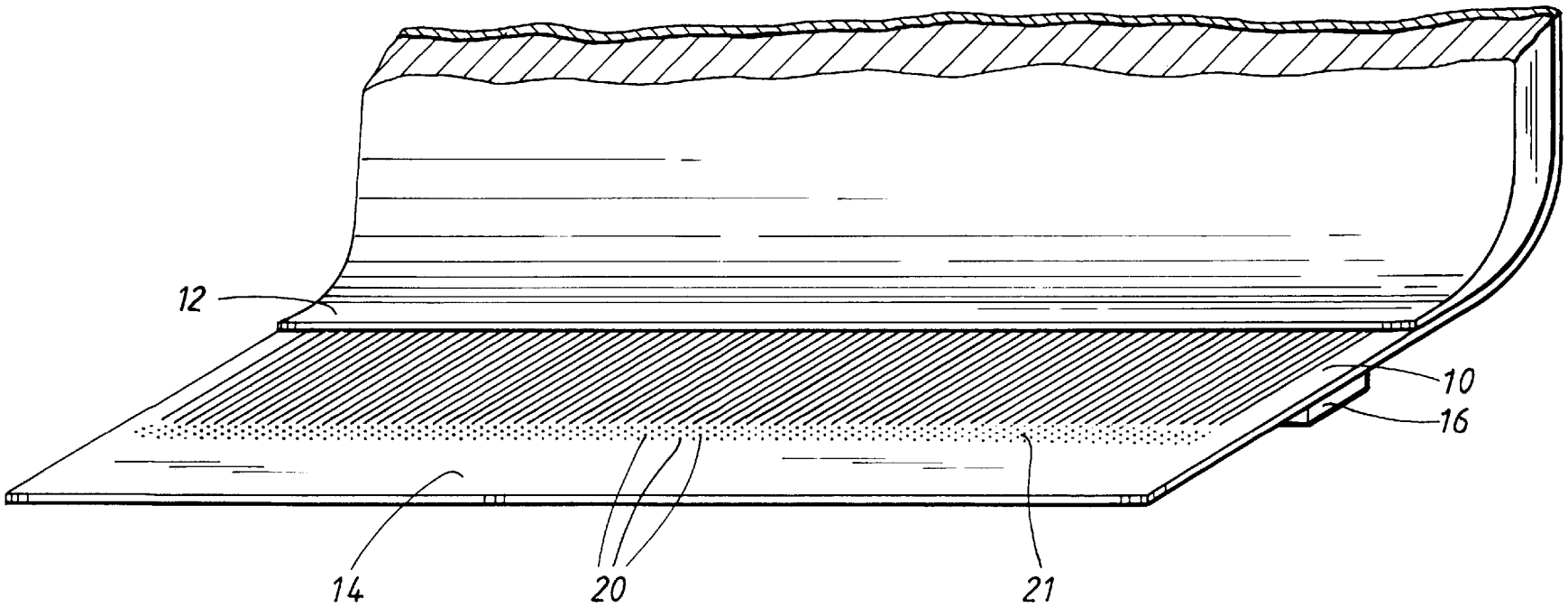
FIG. 2 is a perspective view of a control unit (FPC) mounted on a support wall.
Figure 3:
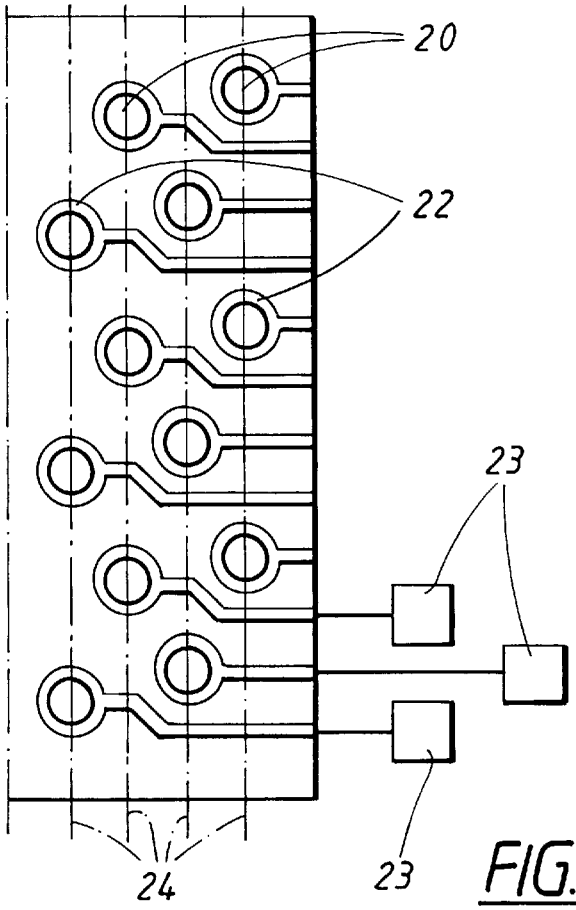
FIG. 3 is an enlarged plan view of the FPC shown in FIG. 2.

As can best be seen in FIGS. 2 and 3 the FPC 10 has a plurality of apertures 20 arranged within a band-like area 21 through the flexible flap 14 protruding from the guiding edge 12. The apertures 20 enable particle passage from the developer sleeve surface 8 through the FPC 10 toward the back electrode 1. The apertures 20 are localised within the part of the FPC 10 being positioned in alignment with the print zone 15 of the print head structure.

FIG. 3 is an enlarged view of a portion of the apertured band-like area 21 of the FPC 10. The apertures 20 are arranged in parallel rows 24 extending along the band-like area 21. Each aperture 20 is surrounded by a control electrode 22, individually connected to a control signal source 23. In the print head structure of FIG. 1 the parallel rows 24 of apertures 20 are aligned perpendicularly in a transverse direction to the motion of the information carrier 18, the apertures 20 of each row 24 being staggered in relation to the apertures 20 of neighbouring rows 24, thereby ensuring complete coverage of the information carrier 18 by providing an addressable dot position at every point along any transversal line across the information carrier 18.

The FPC 10 can easily be mounted on the support wall 11 without subjecting it to deforming forces. Further, during the printing procedure, variations in the gap distance, $L_k$, caused by irregularities in the developer sleeve surface 8 or in the particle layer 9 will be compensated by slight movements of the part of the FPC 10 extending freely from the guiding edge 12 on the wall 11. This compensating movement is ensured by the spacer means 16 being in constant contact with the layer 9 of charged particles.

Figure 4:
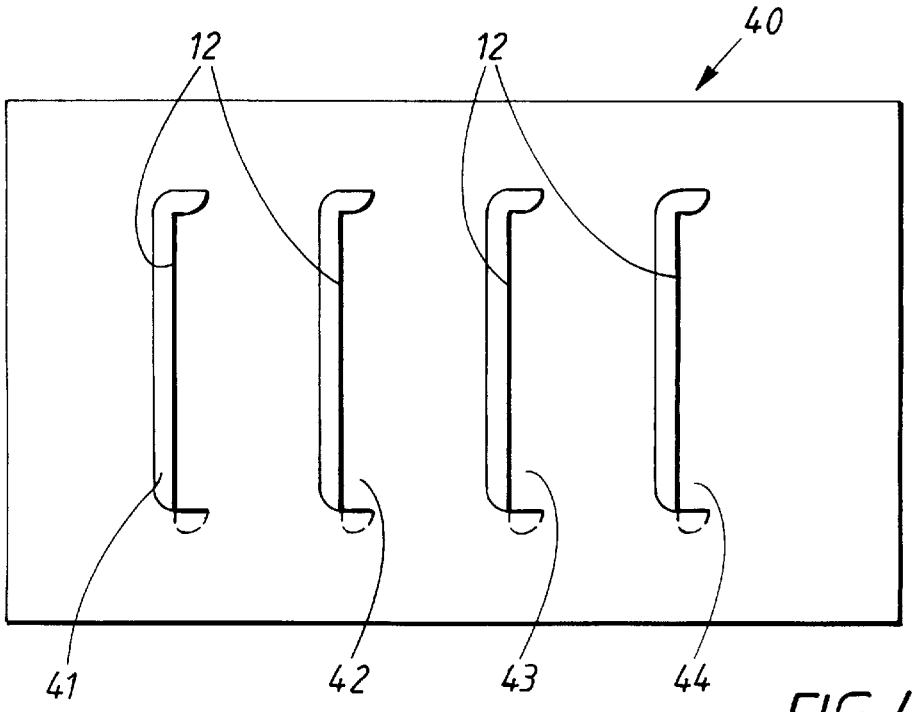
FIG. 4 is a support frame having multiple support locations.

In FIG. 4 there is shown a support frame 40 for supporting four flexible control units in four different locations 41–44. Each location 41–44 has a guiding edge 12 for maintaining a corresponding flexible control unit in a predetermined position in relation to a particle source. The support frame 40 can be produced e.g. by punching of a sheet of metal or plastic or by moulding or casting techniques and can be made to have one or more different support locations.

From the foregoing it will be recognized that numerous variations and modifications may be effected without departing from the scope of the invention as defined in the appended claims.

I claim:

1. A print head structure comprising:

a particle source for delivering charged particles to an information carrier;

a control unit for controlling transfer of the charged particles from the particle source to the information carrier, the control unit being arranged on a carrier sheet of flexible non-rigid material; and a support element for supporting the control unit to form a gap between the particle source and the control unit, the support element comprising a guiding edge, whereby the carrier sheet is fixed to the support element along said guiding edge with a cantilevered portion of the carrier sheet carrying the control unit protruding beyond said guiding edge, wherein the cantilevered portion of the carrier sheet protruding beyond said guiding edge is not fixed.

2. The print head structure of claim 1, wherein the flexible control unit comprises a printed circuit.

3. The print head structure of claim 1, wherein the flexible control unit comprises an electrically insulating, flexible substrate.

4. The print head structure of claim 2, wherein the flexible control unit comprises an electrically insulating, flexible substrate.

5. The print head structure of claim 1, wherein the flexible control unit is adhesively fixed to the support element.

6. The print head structure of claim 1, wherein the flexible control unit is mechanically fixed to the support element.

7. The print head structure according to claim 1, wherein the particle source consists of a rotating developer sleeve having a surface carrying a layer of said charged particles and wherein a spacer means is arranged parallel to the guiding edge, on said portion of said control unit carrying sheet protruding beyond the guiding edge, the spacer means being arranged on a surface of the control unit carrying sheet facing the rotating developer sleeve and being kept in contact with said layer of charged particles by means of the support element.

8. A print head structure for direct electrostatic printing comprising:

a back electrode;

a particle carrying unit for conveying charged particles to a particle source positioned adjacent to the back electrode;

a control unit interposed between the back electrode and the particle carrying unit for converting a stream of electronic signals, defining an image information, to a pattern of electrostatic fields that selectively permit or restrict transport of said charged particles from the particle source toward the back electrode; and a support element for supporting the control unit to form a gap between the particle source and the control unit, the support element comprising a guiding edge, whereby the carrier sheet is fixed to the support element along said guiding edge with a cantilevered portion of the carrier sheet carrying the control unit protruding beyond said guiding edge, wherein the cantilevered portion of the carrier sheet protruding beyond said guiding edge is not fixed.

9. The print head structure according to claim 8, wherein the particle source consists of a rotating developer sleeve having a surface carrying a layer of said charged particles and wherein a spacer means is arranged parallel to the guiding edge, on said portion of said control unit carrying sheet protruding beyond the guiding edge, the spacer means being arranged on a surface of the control unit carrying sheet facing the rotating developer sleeve and being kept in contact with said layer of charged particles by means of the support element.

* * * * *